US005327042A

United States Patent [19]

Bazin et al.

[11] Patent Number: 5,327,042

[45] Date of Patent: Jul. 5, 1994

[54] METAL HALIDE LAMP

[75] Inventors: Simone P. Bazin, Bedford; Richard A. Parrott, Merrimack; Edward H. Nortrup, Bedford, all of N.H.

[73] Assignee: Osram Sylvania Inc., Danvers, Mass.

[21] Appl. No.: 909,234

[22] Filed: Jul. 2, 1992

[51] Int. Cl.[5] ..... H01J 61/34

[52] U.S. Cl. ..... 313/25; 313/571; 313/554; 313/559; 313/642

[58] Field of Search ..... 313/251, 571, 642, 554, 313/555, 559, 561, 562; 252/181.2, 181.6, 181.3

[56] References Cited

U.S. PATENT DOCUMENTS

| | | | |
|---|---|---|---|
| 3,203,901 | 8/1965 | Porta et al. . | |
| 3,549,937 | 12/1970 | Hanada et al. | 313/178 |
| 3,620,645 | 11/1971 | Glorgi et al. | 417/48 |
| 3,829,731 | 8/1974 | T'Jampens et al. | 313/555 X |
| 4,097,195 | 1/1978 | Hill | 313/553 X |
| 4,128,783 | 12/1978 | Giller et al. | 313/555 X |
| 4,163,666 | 9/1979 | Shaltiel et al. | 75/177 |
| 4,200,460 | 4/1980 | Grossman et al. | 75/177 |
| 4,312,669 | 1/1982 | Bofito et al. | 75/177 |
| 4,341,654 | 7/1982 | Sweinhart | 252/181.1 X |
| 4,709,184 | 11/1987 | Keefe et al. | 313/642 X |
| 4,839,085 | 6/1989 | Sandrock et al. | 252/181.6 |
| 4,859,899 | 8/1989 | Keefe et al. | 313/25 |
| 4,963,790 | 10/1990 | White et al. | 313/25 |
| 4,996,002 | 2/1991 | Sandrock et al. | 252/181.6 |
| 5,057,743 | 10/1991 | Krasko et al. | 313/639 |

FOREIGN PATENT DOCUMENTS

| | | | |
|---|---|---|---|
| 0071885 | 6/1979 | Japan | 313/555 |

*Primary Examiner*—Donald J. Yusko
*Assistant Examiner*—Ashok Patel
*Attorney, Agent, or Firm*—Joseph S. Romanow; William H. McNeill

[57] ABSTRACT

A halide discharge lamp has a an evacuated outer envelope including a getter comprising from about 60 to about 85 percent zirconium, from about 10 to about 20 percent vanadium, and from about 2 to about 10 percent manganese having an activation temperature of less than about 350 degrees Centigrade for reducing the tendency of the lamps to discolor during operation.

7 Claims, 1 Drawing Sheet

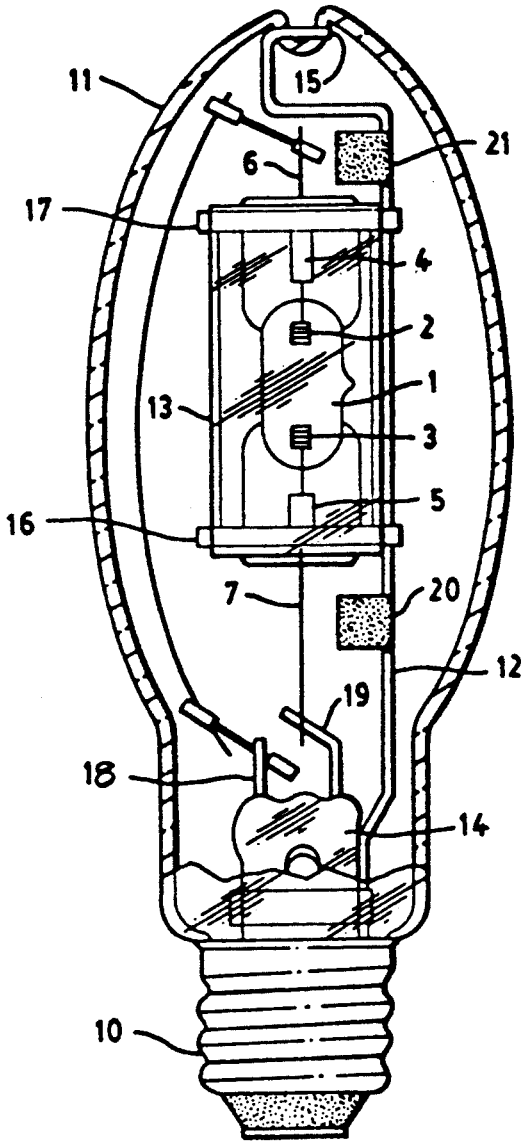
11
15
21
6
17
4
2
1
13
3
5
16
7
20
12
19
18
14
10

METAL HALIDE LAMP

TECHNICAL FIELD OF THE INVENTION

This invention relates to low wattage metal halide lamps, and more particularly to metal halide high intensity discharge lamps utilizing an improved getter for the outer envelope of the lamp.

BACKGROUND OF THE INVENTION

Metal halide lamps have an inner arc tube containing a fill of an arc-sustaining material and surrounded by an outer glass envelope. The metal halide lamp's arc tube fill includes a rare gas for starting and a quantity of mercury. However, as compared to a mercury lamp, the metal halide lamp's emission spectrum is primarily due to the presence in the arc tube fill of one or more metal halides, usually iodides. These metal halides are responsible for a much higher luminous efficacy and better color rendering capability of the lamp output than is possible for the mercury vapor lamp.

The luminous efficacy, color rendering index and other lamp output characteristics may be varied, depending upon the particular composition of the metal halides in the arc tube. GTE's Metalarc M100/U lamp, with a $NaIScI_3CsI$ chemistry, has a CRI (color rendering index) of 65, an initial LPW (lumens per Watt) of 85, and a 10,000 hour lifetime. In the lighting industry, these specifications are considered very good for standard lighting applications. Each chemical in the lamp is chosen to contribute specific effects to the lamp's performance. The mercury controls the current-voltage characteristics of the lamp, and the alkali metal iodides adjust the color quality, and contribute to lumen output through strong emissions. Scandium is added to the lamp as an iodide and as a pure metal. The scandium iodide improves color quality by adding a variety of lines to the color spectrum. The elemental scandium chip is used to adjust the metal/iodine ratio in the lamp and to getter oxygen impurities.

By modifying the above chemistry by the replacement of the element Cesium with Lithium to form a chemistry of $NaIScI_3LiI$, the resulting lamp has an improved CRI of 73 and a high LPW of 85 while still maintaining the 10,000 hour life.

In general, maintaining a proper arc cold spot temperature for the arc tube is conducive to long lamp life. The cold spot temperature is dependent on multiple factors such as light transmissive properties, diameter, length, and wall thickness of the arc tube. Providing an evacuated outer jacket tends to increase the cold spot temperature. The presence of gases in the outer jacket tend to decrease the wall temperature due to convection. Hence, in the vacuum outer jacket of lower wattage bulbs with their smaller volume, it is important to control the presence of gas.

Even though the outer jacket is evacuated, the presence of residual materials may tend to cause darkening of the outer envelope and reduce the lumen output of the lamp. The presence of gas in the outer envelop can result in lower cold spot temperatures which may result in poorer lamp performance. During the operation of the lamp, undesirable materials including hydrogen tend to outgas into the outer envelope so that it is desirable to maintain the vacuum integrity of the outer envelope throughout the entire life of the lamp.

Heretofore, getters have been utilized in the prior art to maintain the vacuum in the outer envelope. However, although prior art getters may be suitable for the higher temperatures achieved in the higher wattage lamps, such getters are not necessarily desirable for lower wattage lamps which operate at lower temperatures. Also, many prior art getters have the disadvantage that high activation temperatures are required to initiate the gettering properties. This activation may be performed prior to lamp operation as a separate step or may occur during operation of the lamp. In either case, proper activation of the getter is a concern. Hence, it is desirable to produce an improved low wattage lamp which obviates one or more disadvantages of prior art lamps. Especially, desirable is a low wattage lamp which is properly gettered so as to desirably enhance the performance of the above discussed lamps.

SUMMARY OF THE INVENTION

It is an object of the present invention to improve color stability lumen maintenance of HID lamps.

It is desirable to provide an HID lamp of low wattage in which the outer envelope is desirably gettered at the time the envelope is evacuated without the need of a separate subsequent activation step.

Other objects and advantages of the present invention are apparent from reading the specification and appended claims.

The importance of maintaining a good vacuum in the outer envelope of a metal halide lamp is known. Gas build up in the outer envelope causes heat to be transferred away from the arc tube by convection causing the arc tube to cool. A cooler arc tube can change the chemistry in the arc and the color of light. In this case, the fill ingredients such as sodium and rare earth iodides may not vaporize and instead condense on the coldest spot of the arc tube. As a result, light output due to mercury in the fill may undesirably dominate the other fill components. This problem is particularly acute in the lower wattage metal halide lamps which typically run at a lower temperature. A desirable property of the getter is to remove gas at the lower temperatures of operation such as typically encountered in the low wattage lamps. Some getters must be activated at temperatures higher than present in the outer jacket during lamp operation. For the lower wattage lamps, such as 30 to 60 watt lamps, it is desirable to utilize a getter that is activated at the relatively low temperature so that a high temperature activation step is not necessary.

The present invention provides a low wattage metal halide discharge lamp of the type having a more stable color during operation. Structurally, the lamp includes an evacuated glass envelope incorporating a getter; a pair of electrical conductors extending into the interior of the glass envelope and an arc tube disposed containing a chemical arc discharge fill and having a pair of electrodes electrically connected to the electrical conductors for creating an electric arc discharge during lamp operation. In accordance with the principles of the present invention, the getter comprises from about 60 to about 85 percent zirconium, from about 10 to about 20 percent vanadium, and from about 2 to about 10 percent manganese having an activation temperature of less than about 350 degrees Centigrade.

BRIEF DESCRIPTION OF THE DRAWINGS

In the drawings:

The single FIGURE is a cross-sectional view of a metal halide discharge lamp.

For a better understanding of the present invention, together with other and further advantages and capabilities thereof, reference is made to the following in conjunction with the accompanying drawings.

DETAILED DESCRIPTION

Referring to the sole FIGURE, there is shown the structural features of a metal halide lamp discharge lamp. The illustrated lamp includes a quartz discharge tube or arc tube 1 disposed within an outer sealed glass envelop 11. The outer envelope is evacuated. The outer envelope 11 is hermetically sealed to an affixed glass stem member 14 having an external base member 10. A pair of electrical conductors 18 and 19 are sealed into and pass through the stem member 14.

The discharge tube 1 has a pair of electrodes 2 and 3 which project into the interior of the discharge tube 1 at respective ends provide for energization of the discharge lamp by an external source (not shown) during operation. Discharge tube 1 is generally made of quartz although other types of material may be used such a alumina, yttria or silica. Each electrode 2 and 3 comprises a core portion surrounded by molybdenum or tungsten wire coils.

Each of the electrodes 2 and 3 is connected to respective metal foils 4 and 5, preferably formed of molybdenum which are pinch sealed. Electrical conductors 6 and 7 which are electrically connected to respective foils, 4 and 5, extend outwardly of the respective press seals. Conductors 6 and 7 are respectively connected to the conductors 18 and 19 projecting from the glass stem member 14. As illustrated in the drawing, the connection between conductor 6 and conductor 18 is made by a vertically disposed wire extending exterior to the radiation shield 13. A pair of getters 20 and 21 are mounted to the support structure 12.

The discharge tube 1 which is positioned interior the radiation shield 13 is electrically isolated from the radiation shield 13 and the support structure 12. Such a "floating frame" structure is used to control the loss of alkali metal from the arc tube fill by electrically isolating the support structure. Such a structure is described issued U.S. Pat. No. 5,057,743 to Krasko et al and in U.S. Pat. No. 4,963,790 of White et al which specification is incorporated by reference into the present specification.

A radiation shield 13 is secured to the support structure 12 by spaced apart straps 16 and 17 which are respectively welded to a vertically aligned portion of the support member 12. The radiation shield 13 has a cylindrical shape and is typically in the form of a quartz sleeve which may or may not have a domed shaped closure at one end. Each of the straps 16 and 17 is made of a spring like material so as to grippingly hold the shield 13 in position. As set forth in U.S. Pat. No. 4,859,899, issued Aug. 22, 1989, the diameter and length of the radiation shield may be chosen with respect to the arc tube dimensions to achieve the optimal radiation redistribution resulting in uniform arc tube wall temperatures.

The drawing illustrates a mogul type base, e.g., such as an E27 screw base but it is contemplated that the lamp may have a medium base or double-ended configuration.

The lamp may include other structural features commonly found in metal halide lamps such as an auxiliary starting probe or electrode, generally made of tantalum or tungsten which may be provided at the base end of the arc tube adjacent the main electrode 3.

The discharge tube 1 contains a chemical fill of inert starting gas, mercury, alkali metal iodides, and scandium iodide. In dispensing the chemical fill into the arc tube of a lamp of the present invention, the non-gaseous components of the fill are preferably dispensed into the unsealed arc tube prior to introduction of the starting gas.

A charge of mercury is present in a sufficient amount so as to enhance the electrical characteristics of the lamp by desirably reducing the amperage requirements needed to sustain a desirable discharge in the arc tube. Such an amount should provide an operating pressure of from 1 to about 100 Torr, and preferably from about 1 to about 10 atmospheres as calculated on the basis of an average gas temperature of about 2000° K.

In addition to mercury, a small charge of an inert ionizable starting gas such as argon is contained within the discharge tube. It is contemplated that other noble gases can be substituted for argon provided an appropriate pressure is maintained that is conducive to starting the lamp and minimizing electrode sputtering or evaporation.

One type of lamp that can be utilized in conjunction with the getters set forth herein is described in U.S. Pat. No. 4,709,184 to Keeffe and Krasko. The lamp described utilizes scandium iodide and the alkali metal iodides are present as the chemical fill and in the discharge gas during lamp operation. The preferred ingredients of scandium iodide and the alkali metal iodides are preferably present in a ratio which provides a warm color of lamp light output match up or comparability to the output of an incandescent lamp. It is contemplated that the present invention may be utilized in lamps containing a variety of chemical fills.

The wall temperature of the discharge tube 1 is a matter of selecting proper design criteria. The wall temperature is dependent on multiple factors such as light transmissive properties, diameter, length, and wall thickness of the arc tube. Providing an evacuated outer jacket tends to increase the cold spot temperature. The cold spot temperature of the arc tube in the lamp of the present invention is preferably from about 800 to about 1000 degrees Centigrade.

The tendency of the lamp to discolor is reduced by the inclusion of the getter material in the evacuated envelope. The getter of the present invention is preferably mounted in the dome area of the evacuated outer envelope in the position shown as reference number 21. The getter material is secured to a ferrous metal backing which can conveniently be secured to the support structure by welding or other attachment technique. The outer envelope of the assembled lamp is subjected to vacuum through a tubulation that is located in the base of the lamp. It is contemplated that prior to evacuation, the outer envelope may be purged with an inert gas to remove reactive gases such as oxygen. The purge and evacuation is preferably performed at oven baking temperatures so that moisture present in the envelope is evacuated.

In accordance with the principles of the present invention, the getter comprises from about 60 to about 85 percent zirconium, from about 10 to about 20 percent vanadium, and from about 2 to about 10 percent manganese having an activation temperature of less than about 350 degrees Centigrade. The preferred getter material is available from Ergenics, Inc. as HY-STOR 405 getter strip and comprises 80 percent zirconium, 15.6 percent vanadium, 4.0 percent manganese, and 0.4 percent aluminum composition mounted on a iron metal backing.

The present invention may advantageously be used for low wattage type metal halide discharge lamps, i.e., those lamps with a wattage less than 175 watts, typically from 40 to 150 watts where lower operating temperatures are present in the outer jacket and the getter as described above having a activation temperature and gettering temperature is advantageous.

The following examples are provided to enable those skilled in this art to more clearly understand and practice the present invention. These examples should not be construed as a limitation upon the scope of the present invention but merely as being illustrative and representative thereof.

EXPERIMENT

Two sets of metal halide lamps were made to compare lamps of the present invention with lamps not including the getter as an aid to reduce color temperature shifts and end coating discoloration of the lamp. Each of the lamps included a quartz arc tube having an internal volume of about 1.25 $cm^3$, an arc gap of about 14 mm., an electrode insertion length of about 4.3 mm, an overall length of 50 mm, and an overall width of 17 mm. The fill of the arc tube of each lamp includes 13.5 milligrams of mercury and 12 milligram of a tri-component chemical fill. On a weight percent bases, the combination fill includes 86% NaI, 4% CsI, and 10% $ScI_3$.

Various getters were tested in the MP50/U (50 watt) metal halide lamps having the above specification. Also, the 75 watt and 100 watt lamps were tested. The getter was mounted on a wire support in the air evacuated outer jacket. Some of the arc tubes were "air burned" and some were not. "Air burn" refers to burning or heating the end paint or zirconium dioxide coating on the arc tube in air to prevent contamination of the outer envelope during lamp operation. The lamps were evaluated at 0, 24, and 100 hours for the gas content in the outer envelope. Observations were made on the physical appearance of the lamps.

Lamps equipped with the Ergenics 405 HY-STOR were compared to lamps equipped with the SAES ST198. SAES recommended the ST198 as the preferred getter for low temperature gettering in metal halide lamps. As per SAES literature, the composition of the alloy is 76.6% Zr and 23.4% Fe.

The lamps with the Ergenics 405 getter have a much cleaner appearance than the ST198 getter lamps. There is less gas in the outer envelope of lamps containing HY-STOR 405 initially after evacuation of the outer jacket and after a period of lamp operation. The lamps utilizing Ergenics 405 getter that were not air burned still retained a good vacuum after lamp operation. In these lamps, the arc tube was not lit until after the outer jacket was sealed. The gases from burning were confined to the outer jacket rather than being vented to the atmosphere such as would occur during an air burning step. The cleaner appearance and lack of gas in no air burned lamps was surprising. The ability of the Ergenics HY-STOR 405 to absorb gases from the zirconium dioxide coating advantageously eliminates the separate burning step normally required prior to installation of the arc tube.

Another advantage of the Ergenics 405 is a good vacuum in the outer envelope immediately after the outer envelope is exhausted and sealed. This step which occurs in an oven at a temperature of about 600 degrees F. (319 degrees C.) activates the Ergenics getter so that gases are immediately absorbed. This temperature is probably hotter than the temperature of the outer envelope during lamp operation. When the SAES 198 is used, the outer envelope is extremely gasey after the exhausting and sealing steps. Thus, an advantage of using the Ergenics 405 is that it can be immediately determined whether the lamp is properly sealed by the presence of a good vacuum. On the other hand, even a properly sealed outer envelope using the SAES getter is extremely gassy so it is difficult to determine the effectiveness of the seal.

Due to the low activation temperature of the zirconium, vanadium, and manganese getter which is preferably mounted in the dome area of the envelope, the getter is activated during the evacuation step which is performed at oven baking temperatures. Preferably the temperatures are from about 500 degrees F. to about 700 degrees F.

While there has been shown and described what at present is considered the preferred embodiment of this invention, it will be apparent to those skilled in the art that various changes and modifications may be made therein without departing from the invention as defined by the appended claims.

What is claimed is:

1. A metal halide discharge lamp comprising:

an outer evacuated sealed glass envelope and a getter material contained in said envelope for removing gaseous materials therefrom, a pair of electrical conductors extending into the interior of said glass envelope;

an arc tube disposed within the outer glass envelope, said arc tube containing an arc sustaining chemical fill and including a pair of spaced electrodes being electrically connected to said electrical conductors for creating an electric arc during operation of said lamp;

said getter material comprising from about 60 to about 85 percent zirconium, from about 10 to about 20 percent vanadium, and from about 2 to about 10 percent manganese, and having an activation temperature of less than about 350 degrees Centigrade.

2. A metal halide discharge lamp in accordance with claim 1 wherein said chemical fill comprises an inert starting gas, mercury, and alkali metal iodides selected from the group consisting of the alkali metals of sodium, lithium, and cesium.

3. A metal halide discharge lamp in accordance with claim 1 wherein said lamp has a wattage of 40 to 150 watts.

4. A metal halide discharge lamp in accordance with claim 3 wherein said getter material comprises 80% Zr, 15.6% V, 4.0% Mn, and 0.4% Al composition mounted on a ferrous metal backing.

5. A metal halide discharge lamp in accordance with claim 4 wherein said getter material is mounted in the dome area of the evacuated outer envelope.

6. A metal halide discharge lamp in accordance with claim 5 wherein said getter material is secured to said support structure.

7. A metal halide discharge lamp in accordance with claim 6 wherein said ferrous metal backing is secured to said support structure by welding.

* * * * *